US007040018B2

(12) United States Patent
Lohbeck et al.

(10) Patent No.: US 7,040,018 B2
(45) Date of Patent: May 9, 2006

(54) RADIALLY EXPANDABLE TUBULAR WITH SUPPORTED END PORTION

(75) Inventors: Wilhelmus Christianus Maria Lohbeck, Rijswijk (NL); Franz Marketz, Rijswijk (NL); Erik Marco Nijveld, Rijswijk (NL); Antonius Leonardus Maria Wubben, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/478,564

(22) PCT Filed: May 22, 2002

(86) PCT No.: PCT/EP02/05602

§ 371 (c)(1),
(2), (4) Date: Mar. 17, 2004

(87) PCT Pub. No.: WO02/095181

PCT Pub. Date: Nov. 28, 2002

(65) Prior Publication Data

US 2004/0148758 A1 Aug. 5, 2004

(30) Foreign Application Priority Data

May 24, 2001 (EP) ..... 01304604

(51) Int. Cl.
*B21D 51/16* (2006.01)

(52) U.S. Cl. ..... 29/890.144; 29/523; 29/421.1

(58) Field of Classification Search ..... 29/523, 29/421.1, 890.144, 522.1, 507; 285/24, 332.3
See application file for complete search history.

(56) References Cited

U.S. PATENT DOCUMENTS 2,160,263 A * 5/1939 Fletcher ..... 285/115
2,259,232 A * 10/1941 Stone ..... 175/325.5

(Continued)

FOREIGN PATENT DOCUMENTS

EP 0386895 9/1990

(Continued)

OTHER PUBLICATIONS

International Search Report dated Aug. 30, 2002.

(Continued)

*Primary Examiner*—Marc Jimenez
(74) *Attorney, Agent, or Firm*—Rachael Stiegel

(57) ABSTRACT

A method is provided of radially expanding a connector for interconnecting a first tube to a second tube, the connector including a pin member extending into a box member. The pin and box members have cooperating support means arranged to support the pin member so as to prevent radially inward movement of the end portion of the pin member relative to the box member. The method involves radially expanding the connector, and supporting the pin member so as to prevent radially inward movement of the end portion of the pin member relative to the box member.

29 Claims, 1 Drawing Sheet

U.S. PATENT DOCUMENTS

| | | | | | |
|---|---|---|---|---|---|
| 2,761,205 | A | * | 9/1956 | Siklosi | 29/447 |
| 3,502,150 | A | | 3/1970 | Dunlap | 166/315 |
| 3,667,252 | A | | 6/1972 | Nelson | |
| 4,214,358 | A | * | 7/1980 | Clerc | 29/520 |
| 4,253,687 | A | | 3/1981 | Maples | |
| 4,429,904 | A | | 2/1984 | Reimert | |
| 4,525,001 | A | | 6/1985 | Lumsden et al. | |
| 4,629,221 | A | | 12/1986 | Lumsden et al. | |
| 4,648,627 | A | | 3/1987 | Reimert | |
| 4,875,710 | A | * | 10/1989 | Mercado | 285/24 |
| 5,017,160 | A | | 5/1991 | Garcia | |
| 5,964,486 | A | * | 10/1999 | Sinclair | 285/331 |
| 6,712,401 | B1 | * | 3/2004 | Coulon et al. | 285/331 |

FOREIGN PATENT DOCUMENTS

| | | |
|---|---|---|
| EP | 0957233 | 11/1999 |
| WO | 00/66929 | 11/2000 |
| WO | 01/04520 | 1/2001 |

OTHER PUBLICATIONS

EP Search Report dated Nov. 27, 2001.

* cited by examiner

RADIALLY EXPANDABLE TUBULAR WITH SUPPORTED END PORTION

FIELD OF THE INVENTION

The present invention relates to a method of radially expanding a connector for interconnecting a first tube to a second tube, the connector including a pin member extending into a box member.

BACKGROUND OF THE INVENTION

Radially expanded tubular elements can be applied in numerous applications, such as in wellbore applications where hydrocarbon fluid is produced from an earth formation. For example, it has been tried to expand tubular wellbore casing in order to allow larger downhole wellbore diameters to be achieved compared to conventional wellbore construction wherein a plurality of casings are arranged in a nested drilling procedure whereby for each newly drilled interval a new casing is lowered through the previously drilled and cased interval(s), which new casing therefore necessarily needs to be of smaller outer diameter than the inner diameter of the previously installed casing(s). This has been improved by radially expanding the new casing after having been lowered through the previously installed casing(s), whereby the new casing deforms plastically. The expanded casing allows passage therethrough of a larger diameter drill bit so that the wellbore can be further drilled at a larger diameter than in the conventional situation. A further casing is then lowered through the previously installed and expanded casing, and thereafter expanded, etc.

The end portion of an expanded tubular element, such as the end portion of the pin member of a connector, has a tendency to axially shorten due to the imposed circumferential strain in the wall of the pin member. The imposed circumferential strain at the inner surface is larger than the imposed circumferential strain at the outer surface. This can be understood by considering that the circumferential strain at the inner surface is $\Delta D/D_i$ and the circumferential strain at the outer surface is $\Delta D/D_o$, and that $D_i$ is smaller than $D_o$. Here $D_i$ is the inner diameter of the pin member, $D_o$ is the outer diameter of the pin member, and $\Delta D$ is the change in diameter due to the expansion process. Since the circumferential strain at the inner surface is larger than the circumferential strain at the outer surface, the tendency to shorten is larger at the inner surface than at the outer surface leading to a tendency of the pin member to bend radially inward. At locations remote from the end of the pin member, radially inward bending does not occur in view geometrical constraints. However, the end portion of the pin member does radially bend inwardly if no corrective measures are taken. Of course, the end portion of the box member also has a tendency to bend radially inward. However, inward bending of the box member end portion is less of a problem than inward bending of the pin member as the latter phenomenon causes an internal upset of the tubular element. Hence it will be understood that such radially inward bending of the pin member is a drawback in many applications of expanded tubulars.

SUMMARY OF THE INVENTION

In accordance with the invention there is provided a method of radially expanding a connector for interconnecting a first tube to a second tube, the connector including a pin member extending into a box member, the pin and box members having cooperating support means arranged to support the pin member so as to prevent radially inward movement of said end portion of the pin member relative to the box member, the method comprising:

radially expanding the connector; and supporting the pin member so as to prevent radially inward movement of said end portion of the pin member relative to the box member.

By supporting the pin member relative to the box member, it is achieved that inward radial movement of the pin member relative to the box member is prevented.

Suitably the pin member is supported so as to prevent said radially inward movement during and after radial expansion of the connector.

Since the pin member is prevented form inwardly bending during and after the expansion process, the pin member remains elastically deformed and therefore remains to have a tendency of inward bending. To prevent such inward bending of the pin member as a result of axial displacement of the pin member relative to the box member, it is preferred that the support means includes at least one support surface extending in substantially axial direction of the connector, each support surface being provided at one of the pin and box members. Thereby it is achieved that the axial support surface prevents inward bending irrespective of the axial position of the pin member relative to the box member.

Suitably the support surface is formed by a recess provided in one of the pin and box members, and wherein the other of the pin and box members extends into said recess.

Preferably the support means includes a first said support surface provided at the pin member and a second said support surface provided at the box member, the first support surface being supported by the second support surface.

To achieve a metal-to-metal seal between pin and box members it is preferred that the first and second support surfaces are compressed against each other as a result of radial expansion of the connector.

BRIEF DESCRIPTION OF THE DRAWINGS

The invention will be described hereinafter in more detail and by way of example with reference to the accompanying drawing in which FIG. 1 schematically shows a longitudinal section of an embodiment of a radially expanded tubular element not according to the invention.

DETAILED DESCRIPTION OF THE INVENTION

Figure 1:
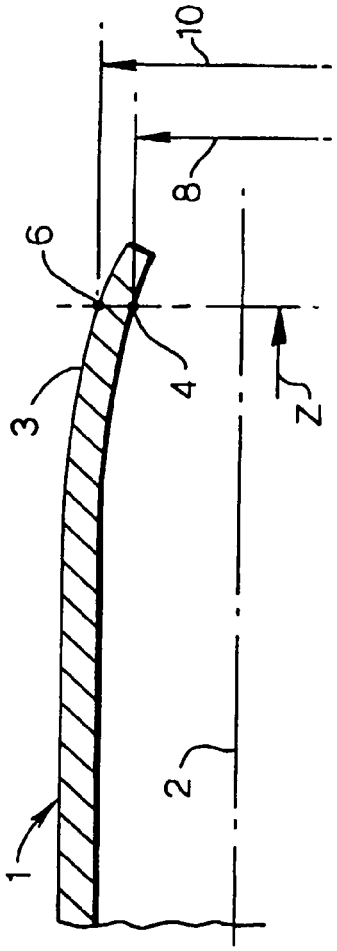

Referring to FIG. 1 there is shown a tubular element 1 having longitudinal axis 2, after the tubular element has been elastically and plastically deformed by expansion in radial direction. The element 1 has an end portion 3 with a point 4 at the inner surface thereof and a point 6 at the outer surface thereof whereby the points 4, 6 are located at axial position Z. Point 4 is located at inner diameter 8 and point 6 at outer diameter 10 of the end portion 3. Ignoring any change of wall thickness of the tubular element 1 due to the expansion process, the magnitude of inner diameter 8 is $D_i+\Delta D$ and the magnitude of outer diameter 10 is $D_o+\Delta D$ wherein $D_i$=inner diameter of the tubular element before expansion;

$D_o$=outer diameter of the tubular element before expansion;

$\Delta D$=increase of the inner and outer diameter of the tubular element due to the expansion process.

The radial expansion process induces positive circumferential strain (also referred to as hoop strain) in the wall material of the tubular element 1. Since the volume of the wall material remains substantially constant during the deformation process, this leads to negative strain in the wall material in radial and/or axial direction. The circumferential strain at point 4 due to the expansion process is $\Delta D/D_i$ and the circumferential strain at point 6 due to the expansion process is $\Delta D/D_o$. Since Do is larger than $D_i$ it follows that the circumferential strain at point 4 is larger than the circumferential strain at point 6. Therefore, the wall material will undergo larger negative strain in radial and/or axial direction at the inner surface than at the outer surface. The larger negative axial strain at the inner surface induces the wall of end portion 3 to bend radially inwards, as schematically shown in FIG. 1. At locations remote from the end portion 3, the wall of the tubular element 1 does not radially bend inwards in view of geometrical constraints of the tubular element 1. At those locations the larger circumferential strain at the inner surface is compensated for by a larger negative radial strain at the inner surface than at the outer surface.

Figure 3:
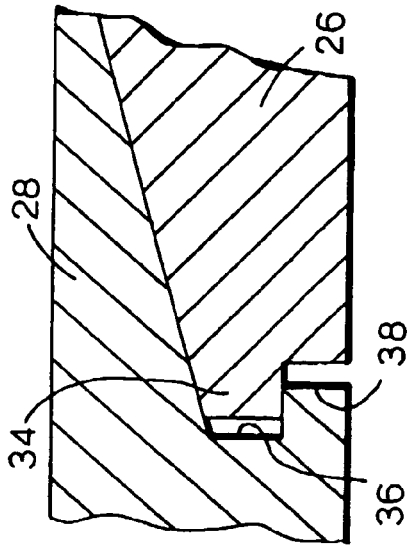
FIG. 3 schematically shows detail A of FIG. 2.
Figure 2:
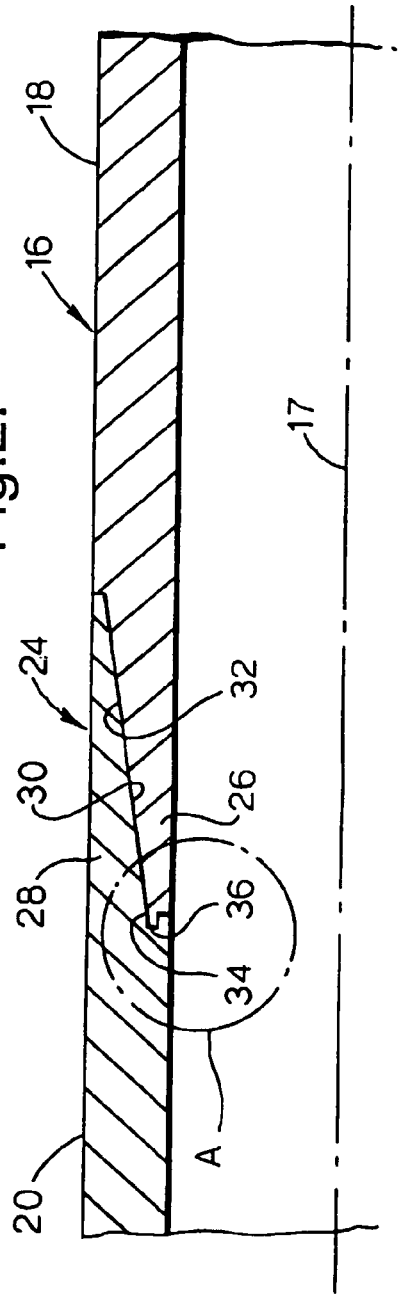
FIG. 2 schematically shows a longitudinal section of an embodiment of a radially expanded tubular element according to the invention.

Referring to FIGS. 2 and 3 there is shown a tube 16 having longitudinal axis 17 and formed of a first tubular element 18 and a second tubular element 20. The tubular elements 18, 20 are connected to each other by a pin/box connector 24 including a pin member 26 being an end portion of the first tubular element 18, and a box member 28 being an end portion of the second tubular element 20. The pin member 26 and the box member 28 have respective tapered contact surfaces 30, 32. The pin member 26 has a nose section 34 which extends into a recess provided in the box member 28, the recess being an annular groove 36 provided in a radially extending surface 38 of the box member 28. By this arrangement the pin member 26 is locked relative to the box member 28 with respect to radial displacement of the pin member 26 relative the box member 28.

During normal operation the tube 16 is radially expanded, for example by pulling or pumping an expander through the tube 16. As explained with reference to FIG. 1 the pin member 26 being an end portion of tubular element 18, and the box member 28 being an end portion of tubular element 20, will tend to bend radially inwards due to the expansion process. However, radially inward bending of the pin member 26 is prevented by virtue of nose section 34 of the pin member 26 being locked into the annular groove 36 of the box member 28. Thus, the pin member 26 remains flush with the inner surface of the tube 16.

In addition, a metal-to-metal seal is obtained between the nose section 34 and the wall of the groove 36 since the tendency of the pin member 26 to bend radially inwards firmly pushes the nose section 34 against the wall of the groove 36.

Furthermore, a second metal-to-metal seal is possibly obtained between the respective contact surfaces 30, 32 due to the tendency of the pin member 26 to bend radially inward and the action of the annular groove 36 to prevent such radially inward bending.

Also, a third metal-to-metal seal is obtained between the respective contact surfaces 30, 32 close to the tip of the box member 28 due to the tendency of the box member 28 to bend radially inward and the action of the pin member 26 prevent such radially inward bending.

To enhance the holding power of the connector 24 and to further reduce the tendency of the pin member 26 to bend radially inwards, a layer of adhesive (e.g. an epoxy based adhesive) can be applied between the pin member 26 and the box member 28 so as to glue the pin and box members to each other.

The expanded tube can be a tube extending into a wellbore for the production of hydrocarbon fluid, for example a wellbore casing or a production tubing.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A method of radially expanding a connector for interconnecting a first tube to a second tube, the connector comprising a pin member on the first tube having an end portion near an open end of the pin member, the pin member extending into a box member on the second tube, the pin and box members having cooperating support means arranged to support the pin member so as to prevent radially inward movement of said end portion of the pin member relative to the box member, the method comprising:

radially expanding the first tube, the second tube, and the connector with an expander; and supporting the pin member so as to prevent radially inward movement of said end portion of the pin member relative to the box member, wherein the pin member is supported so as to prevent said radially inward movement during and after radial expansion of the connector.

2. The method of claim 1, wherein the support means includes at least one support surface extending in substantially axial direction of the connector, each support surface being provided at one of the pin and box members.

3. The method of claim 2, wherein the support surface is formed by a recess provided in one of the pin and box members, and wherein the other of the pin and box members extends into said recess.

4. The method of claim 3, wherein the recess is formed in the box member and wherein the pin member extends into the recess.

5. The method of claim 4, wherein said recess is an annular groove provided in a radially extending surface of the box member.

6. The method of claim 5, wherein the support means includes a layer of adhesive arranged between the pin member and the box member so as to glue the pin and box members to each other.

7. The method of claim 4, wherein the support means includes a layer of adhesive arranged between the pin member and the box member so as to glue the pin and box members to each other.

8. The method of claim 3, wherein the support means includes a first said support surface provided at the pin member and a second said support surface provided at the box member, the first support surface being supported by the second support surface.

9. The method of claim 3, wherein the support means includes a layer of adhesive arranged between the pin member and the box member so as to glue the pin and box members to each other.

10. The method of claim 2, wherein the support means includes a first said support surface provided at the pin member and a second said support surface provided at the box member, the first support surface being supported by the second support surface.

11. The method of claim 10, wherein the first and second support surfaces are compressed against each other due to radial expansion of the connector.

12. The method of claim 11, wherein the recess is formed in the box member and wherein the pin member extends into the recess.

13. The method of claim 11, wherein the support means includes a layer of adhesive arranged between the pin member and the box member so as to glue the pin and box members to each other.

14. The method of claim 10, wherein the recess is formed in the box member and wherein the pin member extends into the recess.

15. The method of claim 10, wherein the support means includes a layer of adhesive arranged between the pin member and the box member so as to glue the pin and box members to each other.

16. The method of claim 2, wherein the support means includes a layer of adhesive arranged between the pin member and the box member so as to glue the pin and box members to each other.

17. The method of 1, wherein the support means includes a layer of adhesive arranged between the pin member and the box member so as to glue the pin and box members to each other.

18. The method of claim 1, wherein the connector is part of a radially expanded tubular element extending into a wellbore.

19. The method of claim 18, wherein the connector is part of a radially expanded wellbore casing.

20. A method of radially expanding a connector for interconnecting a first tube to a second tube, the connector comprising a pin member on the first tube having an end portion near an open end of the pin member, the pin member extending into a box member on the second tube, the pin and box members having cooperating support means arranged to support the pin member so as to prevent radially inward movement of said end portion of the pin member relative to the box member, the method comprising:

radially plastically expanding the first tube, the second tube, and the connector; and supporting the pin member so as to prevent radially inward movement of said end portion of the pin member relative to the box member, wherein the pin member is supported so as to prevent said radially inward movement during and after radial expansion of the connector.

21. The method of claim 20, wherein the support means includes at least one support surface extending in substantially axial direction of the connector, each support surface being provided at one of the pin and box members.

22. The method of claim 21, wherein the support surface is formed by a recess provided in one of the pin and box members, and wherein the other of the pin and box members extends into said recess.

23. The method of claim 22 wherein the recess is formed in the box member and wherein the pin member extends into the recess.

24. The method of claim 23, wherein said recess is an annular groove provided in a radially extending surface of the box member.

25. The method of claim 21, wherein the support means includes a first said support surface provided at the pin member and a second said support surface provided at the box member, the first support surface being supported by the second support surface.

26. The method of claim 25, wherein the first and second support surfaces are compressed against each other due to radial expansion of the connector.

27. The method of 20, wherein the support means includes a layer of adhesive arranged between the pin member and the box member so as to glue the pin and box members to each other.

28. The method of claim 20, wherein the connector is part of a radially expanded tubular element extending into a wellbore.

29. The method of claim 28, wherein the connector is part of a radially expanded wellbore casing.

* * * * *